US007857136B2

(12) United States Patent
Sielski

(10) Patent No.: US 7,857,136 B2
(45) Date of Patent: Dec. 28, 2010

(54) FOLDABLE TRAY FOR PACKAGING BAKERY PRODUCTS

(76) Inventor: Joseph E. Sielski, 3248 E. Marywood St., Orange, CA (US) 92867

( * ) Notice: Subject to any disclaimer, the term of this patent is extended or adjusted under 35 U.S.C. 154(b) by 5 days.

(21) Appl. No.: 12/286,962

(22) Filed: Oct. 3, 2008

(65) Prior Publication Data

US 2010/0084309 A1 Apr. 8, 2010

(51) Int. Cl.
*A45C 11/20* (2006.01)

(52) U.S. Cl. ..... 206/561; 229/904; 229/939

(58) Field of Classification Search ..... 229/108.1, 229/103, 109, 116.1, 117.01, 902, 904, 939; 206/557, 561

See application file for complete search history.

(56) References Cited

U.S. PATENT DOCUMENTS 3,059,763 A * 10/1962 Eifrid ..... 206/400
5,110,038 A * 5/1992 Pantisano et al. ..... 229/103
5,735,520 A * 4/1998 Matos ..... 273/155
7,051,919 B1 * 5/2006 Walsh ..... 229/103
2004/0182859 A1 * 9/2004 Pai ..... 220/9.4
2005/0184066 A1 * 8/2005 Brooks et al. ..... 219/730
2006/0169691 A1 * 8/2006 Rothschild et al. ..... 220/7
2007/0131743 A1 * 6/2007 Fitzwater ..... 229/101.1
2009/0200364 A1 * 8/2009 Oliveira ..... 229/235

* cited by examiner

*Primary Examiner*—Jabob K Ackun, Jr.
(74) *Attorney, Agent, or Firm*—Morland C. Fischer

(57) ABSTRACT

A flat foldable tray preferably manufactured from recycled paper content and having sets of fold lines formed therein along which the tray can be bent to create different geometric shapes for packaging a variety of baked goods, or the like. By way of a preferred embodiment, the foldable tray is a square having four sides of identical length. The sides of the tray and the sets of fold lines are aligned with one another to form the sides of one square, one octagon, and three rectangles, each of which having an identical center and lying inside the perimeter of the square tray. Adjacent fold lines which form the sides of each of the inside square, octagon and rectangles intersect one another at the four sides of the square tray. A pair of dividers may be coupled to one another and attached to the foldable tray at upturned corners thereof to create independent storage compartments in which to carry individual baked goods.

15 Claims, 7 Drawing Sheets

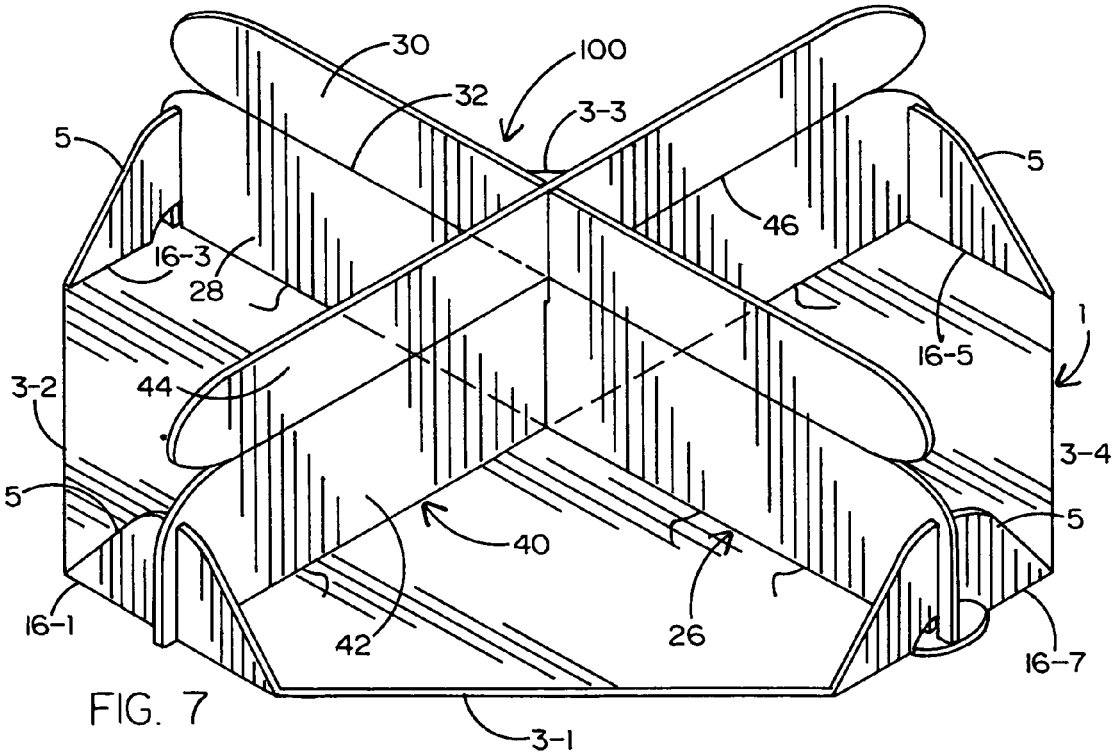
FIG. 7
FIG. 8
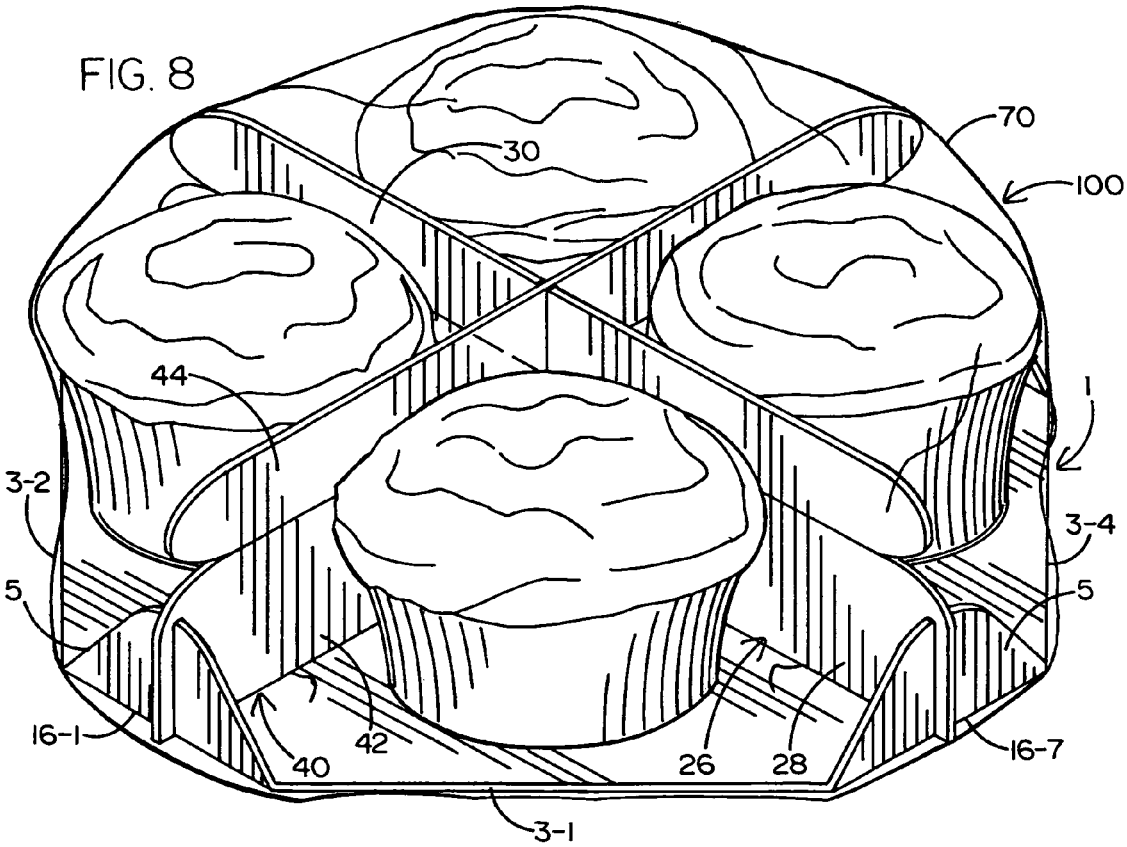

FOLDABLE TRAY FOR PACKAGING BAKERY PRODUCTS

BACKGROUND OF THE INVENTION

1. Field of the Invention

This invention relates to a flat foldable tray having a plurality of fold lines formed therein. The foldable tray is adapted to be bent along selected sets of the fold lines to create different shapes for packaging a variety of different baked goods, or the like.

2. Background Art

Many food products intended for consumption are purchased by consumers and carried from a place of purchase in a package. By way of particular example, it is common for different baked goods (e.g., cookies, doughnuts, cupcakes, etc.) to be packaged prior to their sale to consumers. In many cases, the baked goods are surrounded by an optically-transparent wrap that is applied around the baked goods by means of a well-known over-wrap technique. Since the volume of the baked goods to be packaged will often vary from product to product, many different packages having correspondingly different sizes and capacities are sometimes required to accommodate all of the products to be offered for sale.

As a consequence of the foregoing, raw materials can be wasted while the cost resulting therefrom is frequently passed to consumers. That is to say, a bakery will need to keep on hand ample supplies of different packaging shapes and sizes corresponding to the shapes and sizes of the baked goods to be distributed. Having to continuously store supplies of different packaging is known to consume valuable space. In this same regard, some of the packages will only be used after a long delay or may never be used at all. In this case, the packaging may ultimately be discarded to reduce space consumption.

Accordingly, it would be desirable to have a more efficient and less space-consuming means of packaging baked goods, and the like, regardless of the size and shape of such goods.

SUMMARY OF THE INVENTION

Briefly, and in general terms, a flat foldable tray is disclosed that is preferably manufactured from recycled paper content and is adapted to be bent to create different geometric shapes by which to create packages for a variety of baked goods, and the like, having correspondingly different sizes and shapes. According to a preferred embodiment, the flat foldable tray is a square having four sides of identical length. A slit is formed through each corner of the tray. Tab retaining openings are formed through the tray to lie inwardly of respective corner slits.

The foldable tray is provided with a plurality of fold lines or perforations that are scored, stamped, pressed or cut into at least the top surface thereof. The fold lines are arranged relative to one another to cooperate with the sides of the square tray so as to form the sides or perimeters of one square, one octagon, and three rectangles that lie inside the tray. The foldable tray is bent along selected sets of the fold lines to create different packaging shapes to reflect the baked goods to be packaged therein. The adjacent sides of each of the inside square, octagon and rectangles intersect one another on the sides of the tray.

Each of the inside square, octagon and rectangles has an identical center which corresponds to the center of the square tray. Adjacent fold lines which form the perimeter of the inside square intersect one another at the midpoint of successive ones of the sides of the square tray. Alternating lines which form the perimeter of the inside octagon lie on successive ones of the four sides of the square tray. A first of the three inside rectangles has a major (i.e., its longer) axis lying on a diagonal of the square tray. Adjacent fold lines which form the perimeter of the first inside rectangle intersect one another at successive ones of the four sides of the square tray. A second of the inside rectangles has fold lines which correspond to its longer sides running parallel to a first pair of opposing sides of the square tray. Lines which form the shorter sides of the second inside rectangle lie on the second pair of opposing sides of the square tray. The third of the inside rectangles also has fold lines which correspond to its longer sides running parallel to the same first pair of opposing sides of the square tray. Lines which form the shorter sides of the third inside rectangle also lie on the second pair of opposing sides of the square tray. However, the shorter sides of the third inside rectangle are longer than the shorter sides of the second inside rectangle, such that the third inside rectangle is wider than the second inside rectangle.

One option for folding the square tray is to bend the corners thereof upwardly such that the corner slits are accessible. In this case, a pair of dividers can be attached to one another and then coupled to the folded tray at the slits in the upstanding corners when it is desirable to package and separate relatively large baked goods such as cupcakes, muffins, and the like. Each of the pair of dividers has a laterally-extending fold line along which the dividers can be bent depending upon the height of the backed goods to be packaged.

BRIEF DESCRIPTION OF THE DRAWINGS

FIG. 1 shows a flat tray having a plurality of fold lines formed therein along which the tray can be bent according to a preferred embodiment of this invention to establish different shapes for packaging baked goods, and the like;

FIG. 7 shows the pair of dividers of FIG. 5 coupled to one another and attached to the upstanding corners of the tray shown in FIG. 6 to create independent compartments within which to carry and separate the baked goods;

FIG. 8 shows a cupcake located at and carried within each of the independent compartments created when the dividers are attached to the upstanding corners of the tray as shown in FIG. 7;

FIGS. 10-13 show the flat tray of FIG. 1 being folded along different sets of fold lines to create different packaging shapes suitable to carry different baked goods, or the like.

DESCRIPTION OF THE PREFERRED EMBODIMENT

Figure 1:
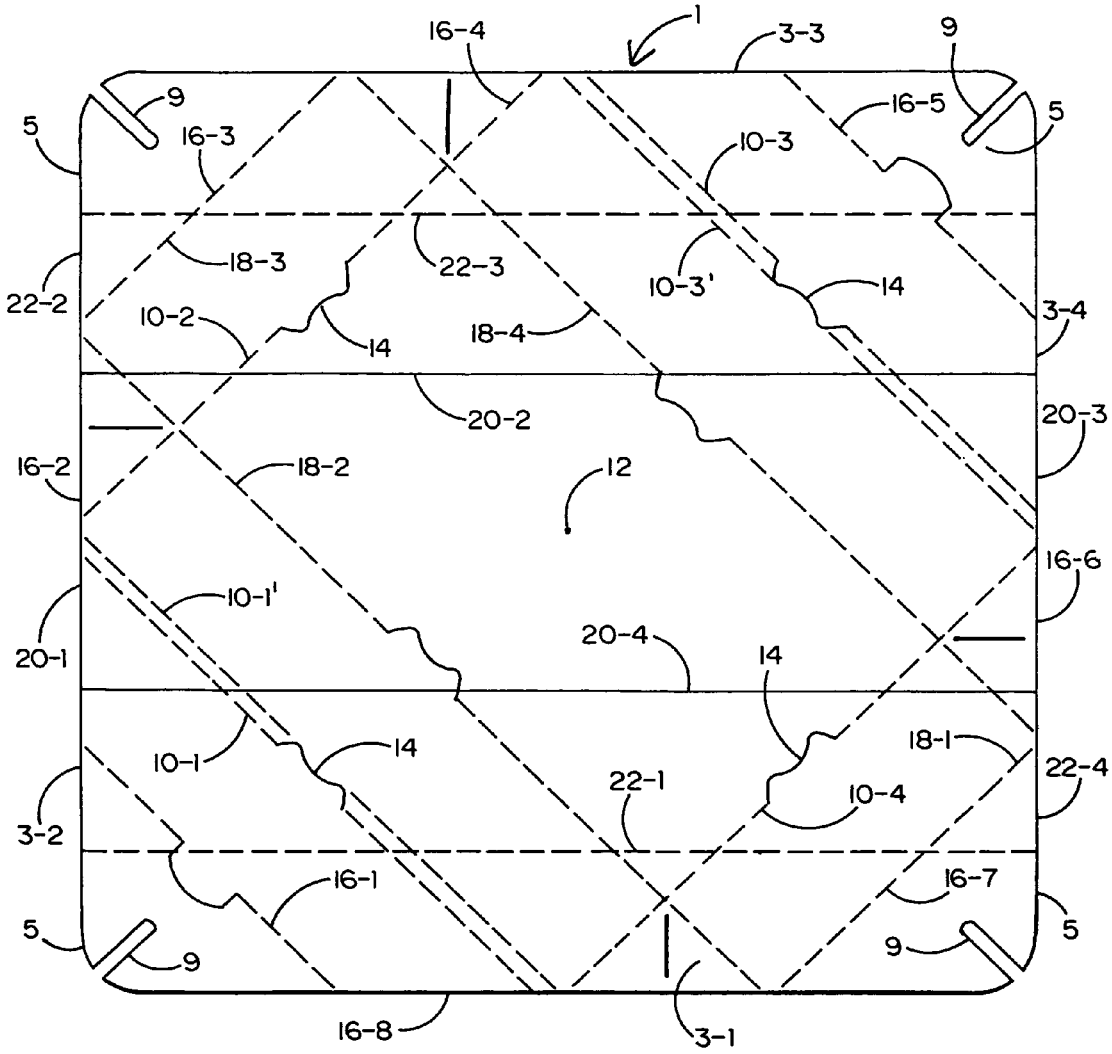
Figure 2:
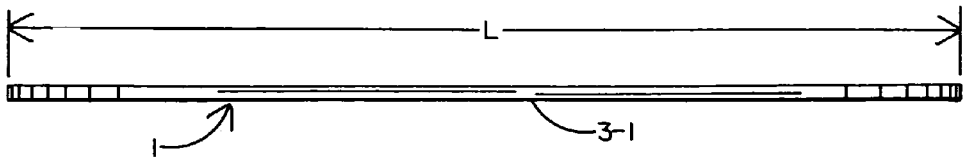
FIG. 2 is a side view of the flat tray shown in FIG. 1.

Referring initially to FIGS. 1 and 2 of the drawings, there is shown according to a preferred embodiment a flat tray 1 that can be conveniently bent to create different geometric shapes by which to make packages for a variety of baked goods that are common to the bakery industry. By virtue of the foregoing, a single flat foldable tray 1 can be advantageously used by bakeries for packaging different baked products rather than requiring a number of different sized packages to accommodate baked goods of different sizes and shapes. Thus, when the foldable tray 1 of this invention is used in combination with well-known over-wrap techniques, baked goods can be economically and efficiently packaged for display and sale so as to reduce storage space, waste and the corresponding packaging costs that are often passed through to purchasers.

The flat tray 1 to be bent into different packaging shapes is preferably a single-wall corrugated blank that is manufactured from recycled paper content. By way of example only, the foldable tray 1 may have either a B, C, E or F-flute cross section. The top and/or bottom surface of the tray 1 on which baked goods will be carried may be covered with an oil-resistant coating. Indicia may be printed on either one of the top and bottom surfaces of the tray 1 to provide information to both purchasers and merchants.

The foldable tray 1 shown in FIG. 1 has a total of four sides 3-1 . . . 3-4. The corners 5 of tray 1 may be either square or rounded. A slit 9 is formed (e.g., cut) inwardly of the tray 1 at each corner 5 thereof. The use of corner slits 9 for enabling the tray 1 to be coupled to a pair of dividers will be described in greater detail hereinafter.

The foldable tray 1 preferably has the shape and dimensions of a square. In this case, the length of each side 3-1 . . . 3-4 of tray 1 is identical. To this end, it has been found that many baked goods can be economically packaged for transport when the length (designated L in FIG. 2) of each side 3-1 . . . 3-4 of tray 1 is approximately 9.0 inches.

In order for the foldable tray 1 to be quickly and easily bent to create different packaging shapes, at least the top surface of the tray is provided with sets of fold lines (best shown in FIG. 1). For example, the fold lines may be established by means of perforations that are punched or cut into the tray 1 and/or score lines that are pressed or stamped into the tray. As will now be explained, the fold lines are positioned to create the perimeters (i.e., sides) of five different geometric configurations that lie within the sides 3-1 . . . 3-4 of tray 1. Different ones of the fold lines can be selected and arranged relative to sides 3-1 . . . 3-4 to make at least 30 different packaging shapes that are capable of accommodating most baked goods that are commercially distributed. In particular, and as is best shown in FIG. 1, the fold lines and the sides 3-1 . . . 3-4 of tray 1 are aligned and cooperate with one another to form the perimeters of one square, one octagon, and three rectangles. The adjacent sides of each of the square, octagon and rectangles intersect one another on the sides 3-1 . . . 3-4 of the square tray 1.

That is to say, a set of four perimeter fold lines 10-1 . . . -4 are connected end-to-end one another to form the sides of an interior square that is located inside the square foldable tray 1. Opposing pairs of fold lines 10-1, 10-1' and 10-3, 10-3' may be included to facilitate bending. Each adjacent pair of fold lines (e.g., 10-1 and 10-2) of the interior square intersects one another at the midpoint of one of the sides (e.g., 3-2) of tray 1. Each longitudinal axis of the interior square extends between a pair of opposing fold lines (e.g., 10-1 and 10-3) and lies on a diagonal of the outer square represented by the tray 1. It may be recognized that perimeter fold lines 10-1 . . . 10-4 create an inside square that is surrounded by an outside square (defined by the sides 3-1 . . . 3-4 of tray 1) where each square has an identical center 12. Push-down tabs 14 cover openings (not shown) formed through the tray 1 at the midpoint of each of the fold lines 10-1 . . . 10-4 of the interior square. The preferred length of each perimeter fold line (i.e., side) 10-1 . . . 10-4 of the interior square is approximately 6.5 inches.

A set of eight perimeter lines 16-1 . . . 16-8 are connected end-to-end one another to form the sides of an interior octagon that is located inside the square tray 1. Each adjacent pair of perimeter lines (e.g., 16-1 and 16-2) of the interior octagon intersects one another at a point that lies on one of the sides (e.g., 3-2) of the square tray 1. In this case, every other one of the perimeter lines (i.e., sides) 16-2, 16-4, 16-6, and 16-8 of the interior octagon lies on one of the sides 3-1 . . . 3-4 of the tray 1. The perimeter lines 16-1 . . . 16-8 create an inside octagon that is surrounded by an outside square (defined by the sides 3-1 . . . 3-4 of the tray 1) with each shape having an identical center 12 (which is also the center of the interior square defined by fold lines 10-1 . . . 10-4 described above). The preferred length of each perimeter line (i.e., side) 16-1 . . . 16-8 of the interior octagon is approximately 3.75 inches.

A set of four perimeter fold lines 18-1 . . . 18-4 is connected end-to-end one another to form the sides of a first interior rectangle that is located inside the square tray 1. Each adjacent pair of fold lines (e.g., 18-1 and 18-2) of the first interior rectangle intersects one another at a point that lies on one of the sides (e.g., 3-1) of the square tray 1. In this case, alternating fold lines (i.e., sides) 18-1 and 18-3 which form the first interior rectangle are identical to the fold lines (i.e., sides) 16-7 and 16-3 which form the interior octagon described above. The longer longitudinal axis of the first interior rectangle extends between opposing fold lines 18-1 and 18-3 and lies on one diagonal of the outer square of tray 1. The shorter transverse axis of the first interior rectangle extends between opposing fold lines 18-2 and 18-4 and lies on the other diagonal of the outer square of tray 1. The perimeter fold lines 18-1 . . . 18-4 create an inside rectangle that is surrounded by the outside square defined by the sides 3-1 . . . 3-4 of tray 1 with each shape having an identical center 12 (which is also the center of the other shapes described above). The preferred length of the fold lines 18-1 and 18-3 of the first interior rectangle is approximately 3.75 inches, and the preferred length of the fold lines 18-2 and 18-4 is approximately 9.25 inches.

A set of four perimeter lines 20-1 . . . 20-4 is connected end-to-end one another to form the sides of a second interior rectangle that is located inside and extends laterally between the sides 3-2 and 3-4 of the square tray 1. Each adjacent pair of perimeter lines (e.g., 20-1 and 20-2) of the second interior rectangle intersects one another at a point that lies on a side (e.g., 3-2) of an opposing pair of sides 3-2 and 3-4 of the outer square of tray 1. In this case, opposing perimeter lines (i.e., sides) 20-1 and 20-3 which form the second interior rectangle lie on respective ones of the opposing pair of sides 3-2 and 3-4 of the tray 1 with each side having an identical midpoint. The longer longitudinal axis of the second interior rectangle which extends between perimeter lines 20-1 and 20-3 corresponds with one axis of the outer square of tray 1 and, therefore, has a preferred length of approximately 9.0 inches. The shorter transverse axis of the second interior rectangle extends between perimeter lines 20-2 and 20-4 and lies on the second axis of the outer square of tray 1 and has a preferred length of approximately 3.375 inches. The perimeter lines 20-1 . . . 20-4 create an inside rectangle that is surrounded by the outside square defined by the sides 3-1 . . . 3-4 of the tray 1 with each shape having an identical center 12 (which is also the center of all of the other shapes described above).

A set of four perimeter lines 22-1 . . . 22-4 is connected end-to-end one another to form the sides of a third interior rectangle that is located inside and extends laterally between the sides 3-2 and 3-4 of the square tray 1. Each adjacent pair of perimeter lines (e.g., 22-1 and 22-2) of the third interior rectangle intersects one another at a point that lies on the same ones of the opposing pair of sides (i.e., sides 3-2 and 3-4) of the outer square of tray 1 at which the adjacent fold lines (e.g., 20-1 and 20-2) of the second interior rectangle described above intersect. The opposing pair of perimeter lines 22-2 and 22-4 of the third interior rectangle lie on respective ones of the opposing sides 3-2 and 3-4 of tray 1 with each overlapping line and side having an identical midpoint. The third interior rectangle has a length between perimeter lines 22-2 and 22-4 which is identical to the length (approximately 9.0 inches) of the second interior rectangle between perimeter lines 20-1 and 20-3. However, the third interior rectangle has a width (between perimeter fold lines 22-1 and 22-3) of preferably approximately 6.25 inches which is greater than the width of the second interior rectangle between perimeter lines 20-2 and 20-4. In this case, the longer longitudinal axis (between the opposing pairs of perimeter lines 20-1, 20-3 and 22-2, 22-4) of the second and third interior rectangles coincide with one another. The shorter transverse axis of the third interior rectangle which extends between perimeter fold lines 22-1 and 22-3 lies on the transverse axes of each of the second interior rectangle between perimeter fold lines 20-2 and 20-4 and the outside square of the tray 1 between sides 3-1 and 3-3. The third interior rectangle has a center 12 which is identical to the centers of all of the other shapes described above.

Figure 3:
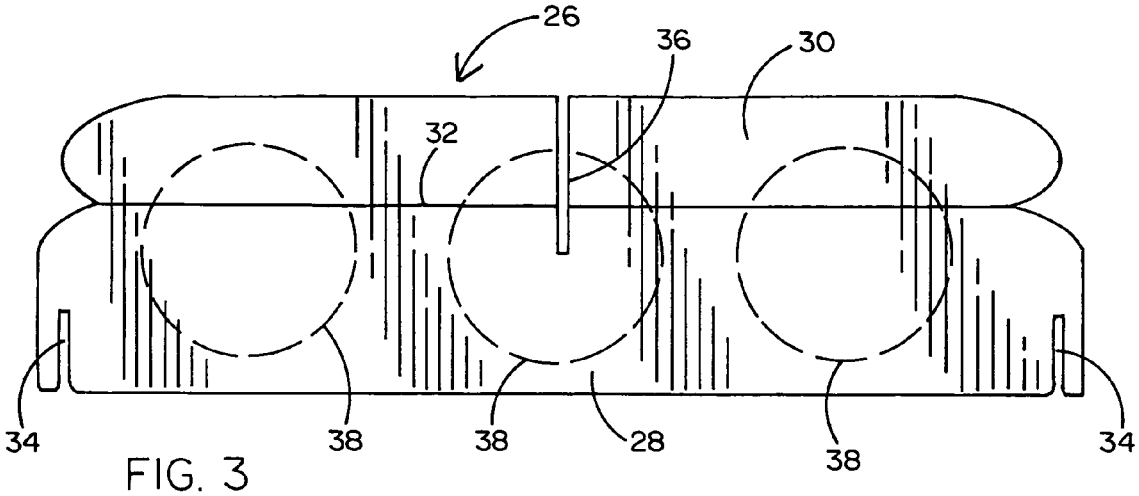
FIGS. 3 and 4 show a pair of dividers that can be coupled to one another and attached to the flat tray of FIG. 1 when the corners of the tray are bent upwardly.
Figure 4:
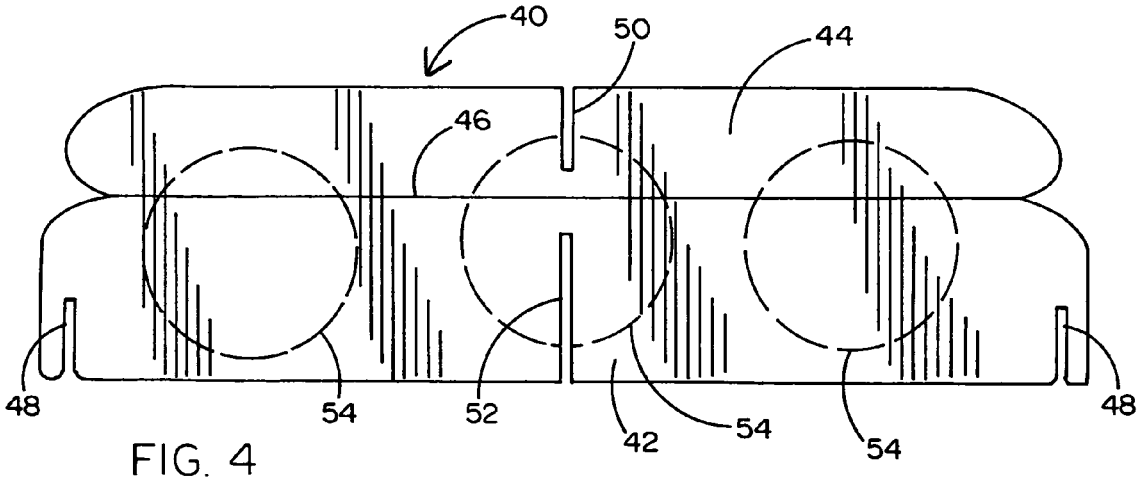

Referring now to FIGS. 3-4 of the drawings, there is shown a set of relatively thin inserts or dividers which can be used in combination with the tray 1 of FIGS. 1 and 2 to carry a number of baked goods depending upon the manner in which the flat blank of tray 1 is folded and the corresponding shape that is achieved as a result thereof. The dividers can be formed from the same (e.g., recycled paper content) material from which the tray 1 is manufactured and include laterally-extending fold lines by which the height (i.e., the tallness or shortness) of the dividers can be selectively adjusted to correspond with the size of the baked goods to be carried.

Figure 9:
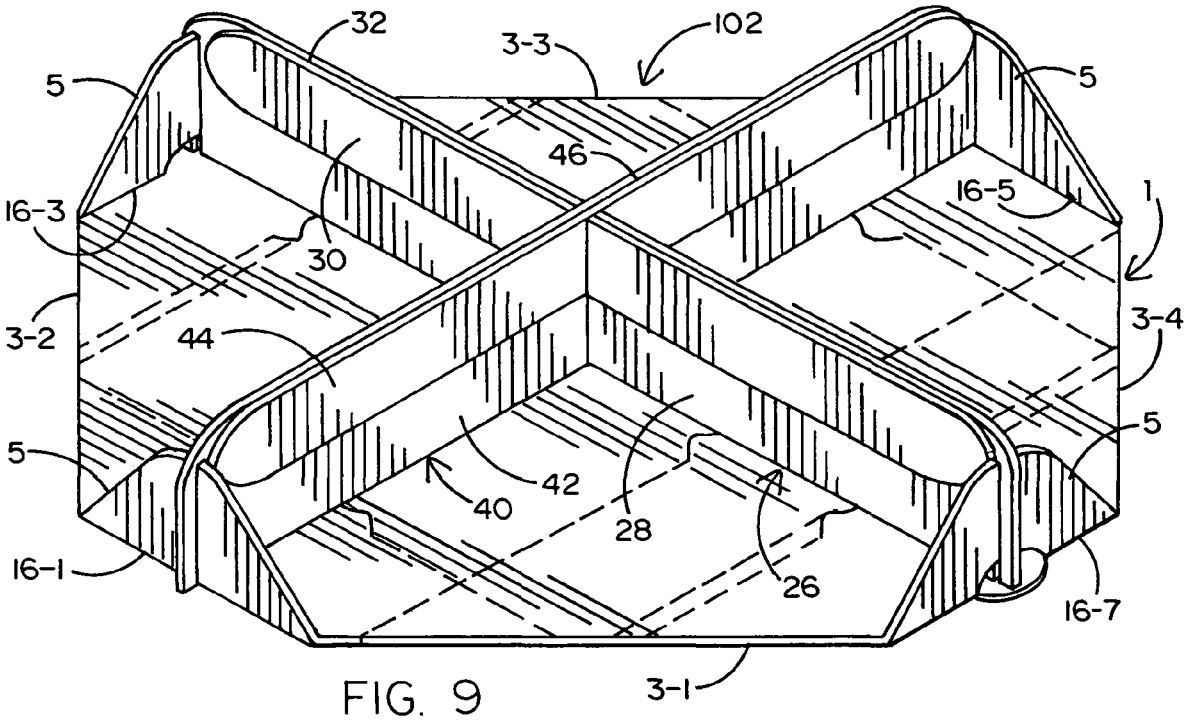
FIG. 9 shows the pair of dividers attached to the upstanding corners of the tray as in FIG. 7, but with each divider being bent along a respective fold line running laterally thereacross.

In the case of FIG. 3, a first divider 26 is illustrated having an elongated base 28 and a top 30 that lies above and is pivotally connected to the base at a laterally-extending fold line or living hinge 32 running therebetween. The divider 26 is preferably approximately 9.5 inches long and 2.75 inches high. A locking notch 34 is formed in each end of the base 28 of divider 26. A coupling notch 36 runs downwardly from the midpoint of the divider 26 completely through the top 30 thereof, past the fold line 32, and into the base 28. A series of (e.g., three) optional circular punchouts 38 are formed in the divider 26. By removing the punchouts 38, the divider 26 can be used to carry muffins or similarly shaped baked goods. As will soon be explained, the divider 26 can be coupled to the tray 1 of FIGS. 1 and 2 in an unfolded, tall configuration as shown in FIG. 3 with the top 30 and the base 28 standing one above the other or a folded, short configuration (illustrated at FIG. 9) with the top 30 rotated downwardly around fold line 32 to lie against the base 28.

Another divider 40 is shown in FIG. 4. Like the divider 26 of FIG. 3, divider 40 includes an elongated base 42 and a top 44 that lies above and is pivotally connected to the base at a laterally-extending fold line or living hinge 46 running therebetween. Also like divider 26, the divider 40 is preferably approximately 9.5 inches long and 2.75 inches high. A locking notch 48 is formed in each end of the base 42 of divider 40. However, in the case of divider 40, an upper coupling notch 50 runs downwardly from the midpoint of divider 40 and into but not completely through the top 44. A lower coupling notch 52 that is located midway between the locking notches 48 runs upwardly into but not completely through the base 42 of divider 40 such that the upper and lower coupling notches 50 and 52 are arranged in spaced axial alignment at opposite sides of the fold line 46. As in the case of divider 26, the divider 40 can be bent from an unfolded, tall configuration as shown in FIG. 4 with the top 44 and the base 42 standing one above the other to a folded, short configuration (illustrated at FIG. 9) with the top 44 rotated downwardly around fold line 46 to lie against the base 42. In the folded short configuration of divider 40, the upper and lower coupling notches 50 and 52 will overlap one another. A series of (e.g., three) optional circular punchouts 54 are formed in the divider 40.

Figure 5:
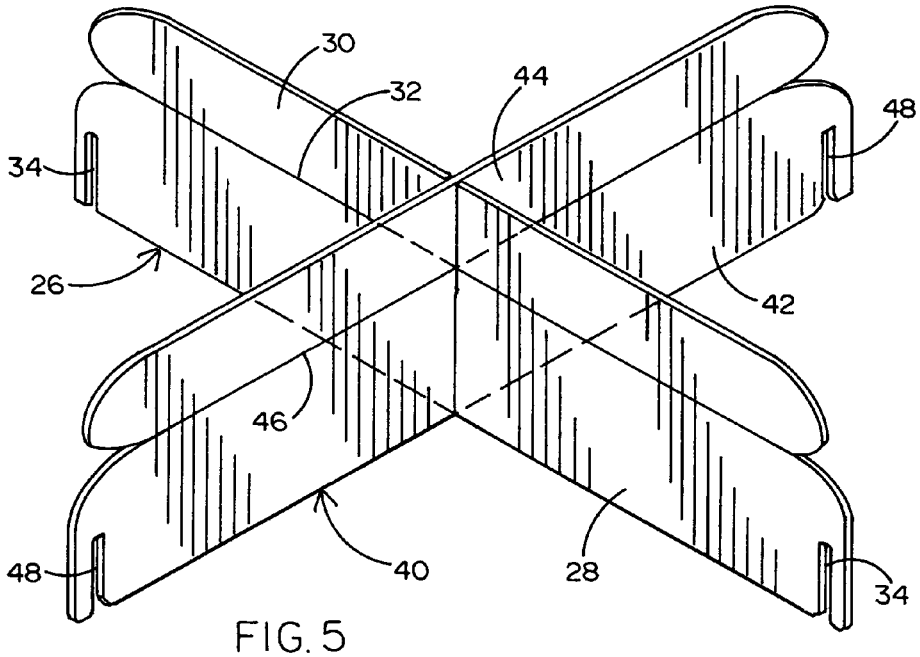
FIG. 5 shows the pair of dividers of FIGS. 3 and 4 coupled to one another.

FIG. 5 of the drawings illustrates the dividers 26 and 40 of FIGS. 3 and 4 coupled to one another and used to create a package (such as that shown in FIGS. 7 and 9) where the product carrying area of the tray 1 is divided into four equally-sized independent compartments. In the case of FIG. 5, the dividers 26 and 40 are coupled together to intersect one another at a right angle. To accomplish the foregoing, the divider 40 is first positioned above the divider 26. The upper divider 40 is then moved downwardly towards and into mating engagement with the lower divider 26 such that the coupling notch 52 of the divider 40 is received in and pushed downwardly through the coupling notch 36 of divider 26. In the event that the dividers 26 and 40 are coupled to one another in their folded short configuration (of FIG. 9) after being bent around respective fold lines 32 and 46, the overlapping coupling notches 50 and 52 of divider 40 are received in and pushed downwardly through the coupling notch 36 of divider 26.

Figure 6:
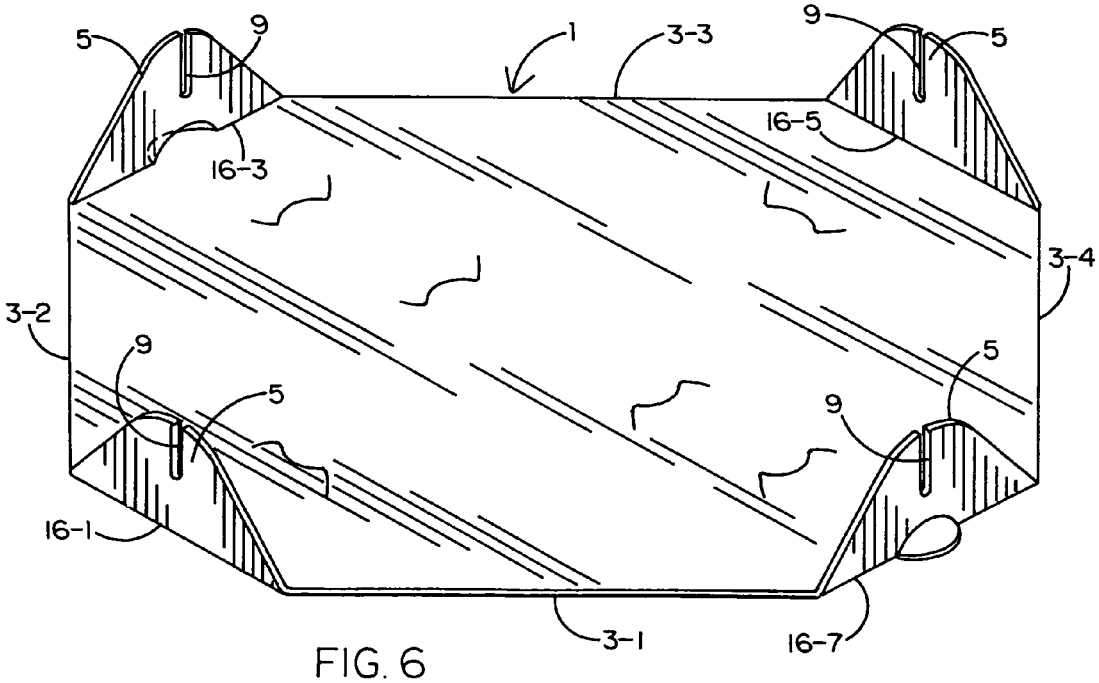
FIG. 6 shows the corners of the flat tray of FIG. 1 bent upwardly along fold lines formed on the tray.

Examples of some of the different shapes into which the foldable tray 1 of FIGS. 1 and 2 can be bent for packaging different baked goods are illustrated by FIGS. 6-13 of the drawings. Turning first to FIGS. 6-8, the foldable tray 1 is shown in combination with the dividers 26 and 40 of FIGS. 3 and 4 that are coupled together in the manner described while referring to FIG. 5 to create a package 100 of FIGS. 7 and 8 suitable for carrying cupcakes, muffins, or the like. In this case, and referring concurrently to FIGS. 1 and 6, the four corners 5 of the square tray 1 are bent upwardly along fold lines 16-1, 16-3, 16-5 and 16-7 corresponding to alternating sides of the inside octagon. Accordingly, the corners 5 stand upwardly for holding the corner slits 9 in perpendicular alignment with the flat tray 1.

In FIG. 7, the pair of dividers 26 and 40 after being coupled together as shown in FIG. 5 are moved into interlocking engagement with the foldable tray that is bent to the configuration shown in FIG. 6. More particularly, the locking notches 34 at opposite ends of the base 28 of divider 26 are pushed downwardly through respective slits 9 formed in a first pair of opposing upstanding corners 5 of tray 1. Similarly, the locking notches 48 at opposite ends of the base 42 of the divider 40 are pushed downwardly through respective slits 9 formed in the second pair of opposing upstanding corners 5. By virtue of the foregoing, the package 100 into which the foldable tray 1 is bent will be divided into four independent compartments for receiving and carrying individual baked goods (e.g., cupcakes) therewithin (best shown in FIG. 8). Separating the goods into independent compartments facilitates stacking a group of packages one above the other. Of course, the type of baked goods to be located within the compartments of the package 100 shown in FIGS. 7 and 8 can be varied to meet the needs of the bakery. The package 100 may be surrounded by a see-through over-wrap 70 (also best shown in FIG. 8) to preserve freshness and retain the cupcakes in place within their respective compartments during transport.

It may be appreciated that the package 100 shown in FIGS. 7 and 8 is particularly adapted to carry relatively tall individual products (e.g., cupcakes) in the four independent compartments formed therein. Therefore, the top 30 of divider 26 stands upwardly from the base 28, and the top 44 of divider 40 stands upwardly from the base 42. In the event shorter products will be carried, a lower profile package may be desirable. In this case, and as represented by the package 102 of FIG. 9, the dividers 26 and 40 are bent at respective fold lines 32 and 46 thereof. More particularly, the top 30 of divider 26 is rotated downwardly at fold line 32 to lie against the base 28, and the top 44 of divider 40 is rotated downwardly at fold line 46 to lie against the base 42. The upper bent divider 40 is coupled to the lower bent divider 26 in the manner described while referring to FIG. 5.

Figure 10:
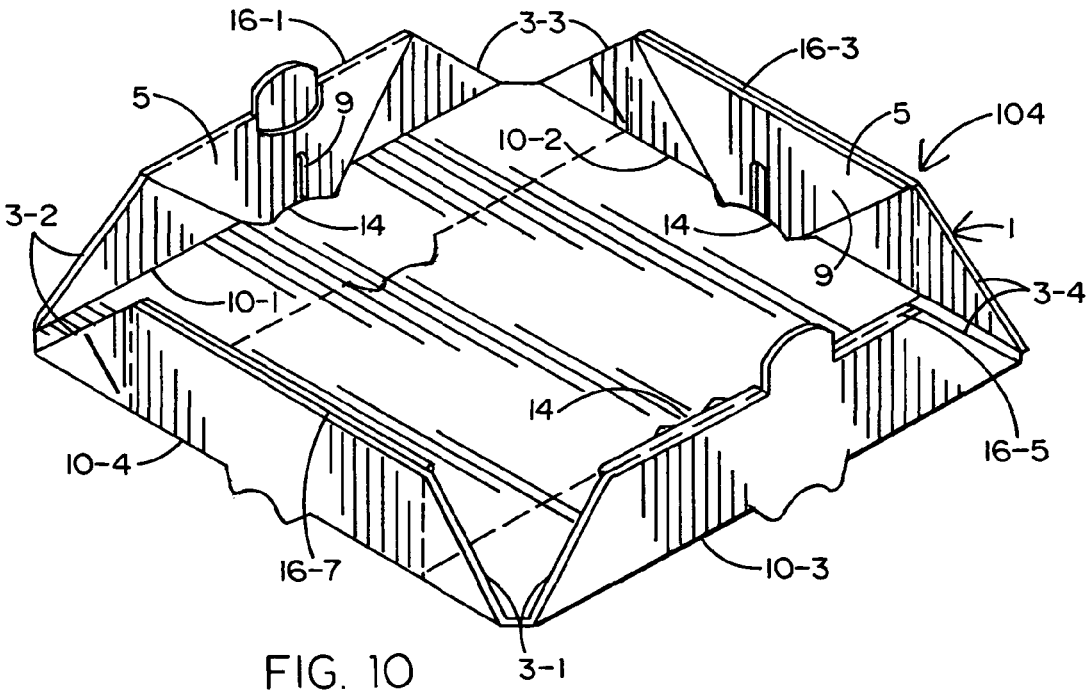

In FIG. 10 of the drawings, the foldable tray 1 is bent to create a package 104 having a single area for carrying low-profile baked goods such as brownies, or the like. In this case, and referring concurrently to FIGS. 1 and 10, the carrying area of package 104 corresponds to the interior square that is established by the four sides (i.e., perimeter fold lines) 10-1 . . . 10-4 which lie inside the sides 3-1 . . . 3-4 of the square tray 1. To create the package 104, the corners 5 of tray 1 are first bent upwardly along the fold lines 16-1, 16-3, 16-5 and 16-7 which correspond to alternating perimeter fold lines or sides of the interior octagon of FIG. 1. Next, the folded corners 5 are bent upwardly along the fold lines 10-1 . . . 10-4 which correspond to successive perimeter fold lines or sides of the interior square of FIG. 1. Finally, the upturned corners 5 are bent downwardly along the aforementioned perimeter fold lines 16-1, 16-3, 16-5 and 16-7 so as to be rotated into interlocking receipt by respective openings formed through the tray 1 and covered by push down tabs 14 located adjacent the fold lines 10-1 . . . 10-4.

Figure 11:
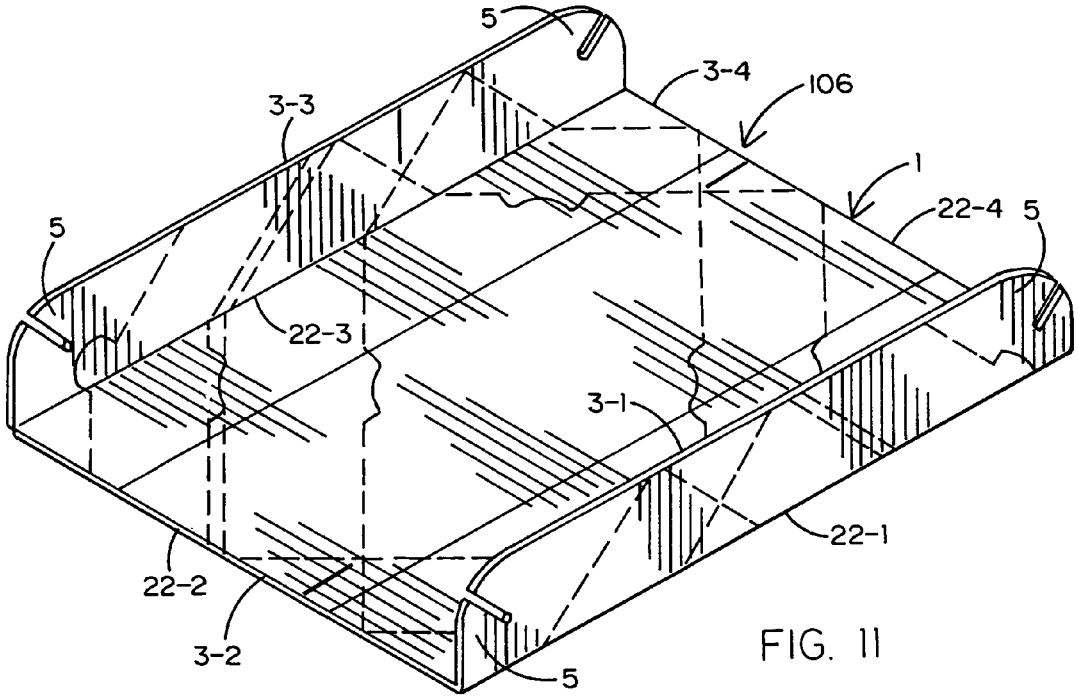

In FIG. 11 of the drawings, the foldable tray 1 is bent to create a package 106 having a single area suitable to carry thin and long baked goods such as a sheet cake, or the like. In this case, and referring concurrently to FIGS. 1 and 11, the carrying area of package 106 corresponds to the third interior rectangle of FIG. 1 established by the four sides (i.e., perimeter lines) 22-1 . . . 22-4. To create the package 106, a pair of the opposite sides 3-1 and 3-3 of the square tray 1 are simply bent upwardly along fold lines 22-1 and 22-3 which correspond to the long sides of the third interior rectangle of FIG. 1.

Figure 12:
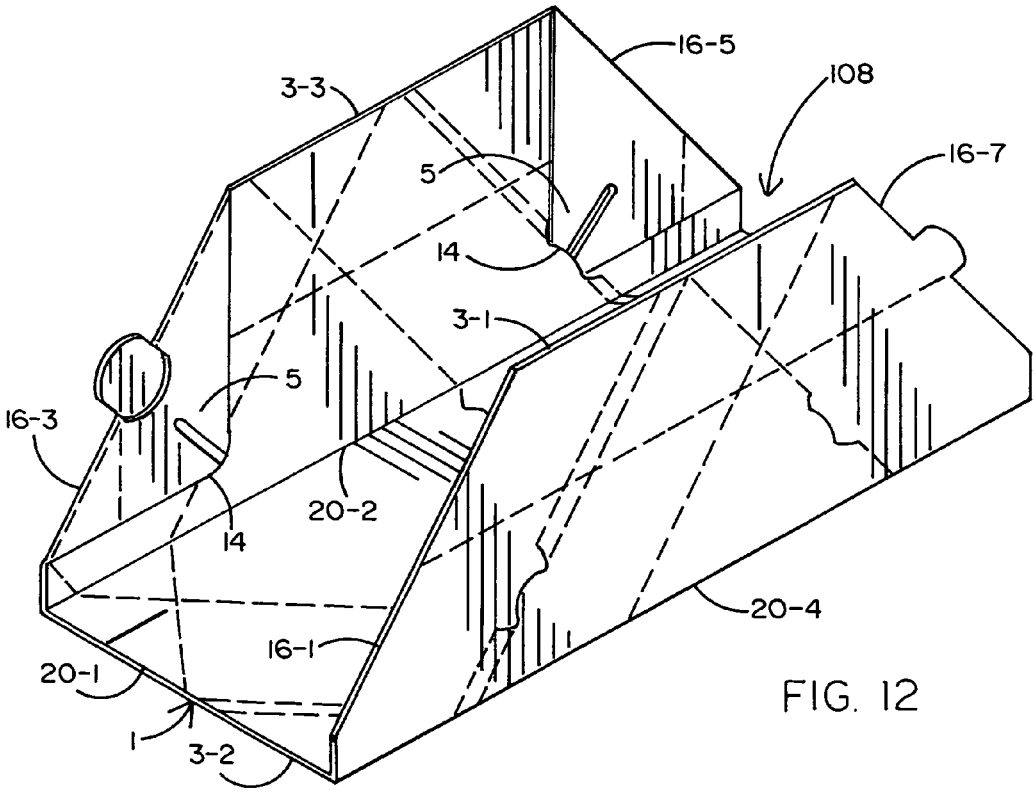
Figure 13:
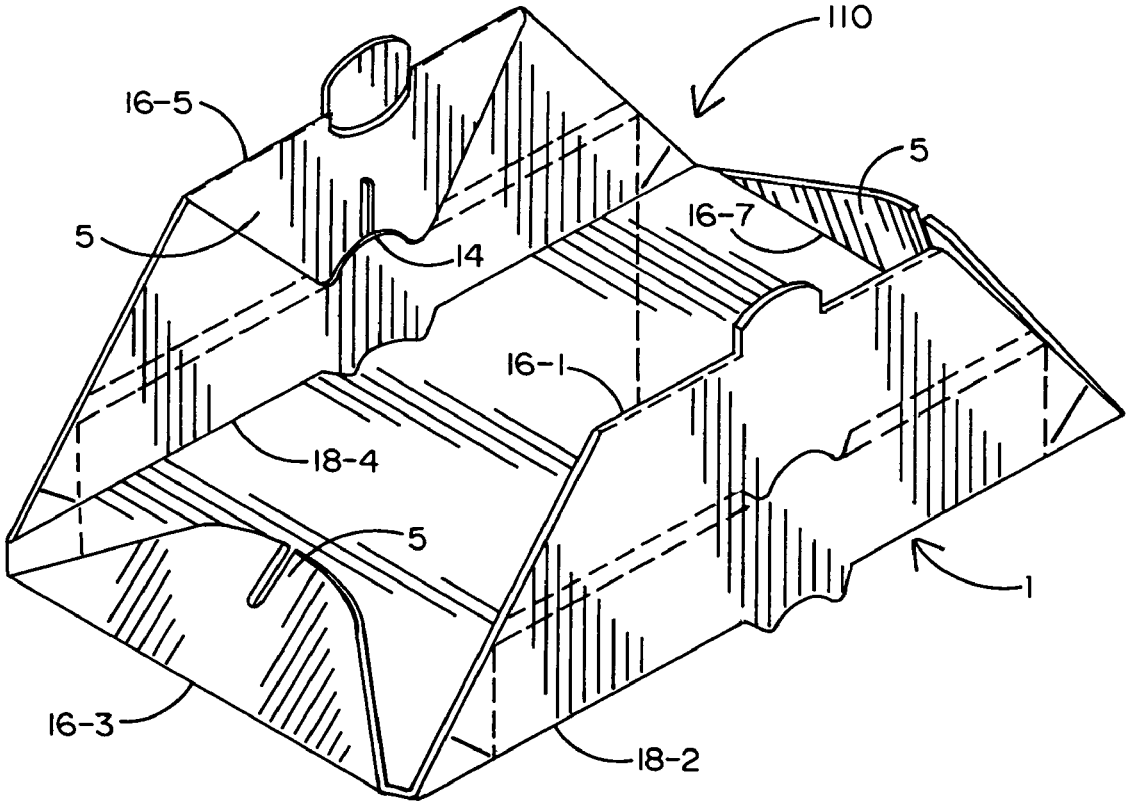

In FIG. 12 of the drawings, the foldable tray 1 is bent to create a package 108 having a single area suitable to carry tall and long baked goods such as a stack of cookies, or the like. In this case, and referring concurrently to FIGS. 1 and 12, the carrying area of package 108 corresponds to the second interior rectangle of FIG. 1 established by the four sides (i.e., perimeter lines) 20-1 . . . 20-4. To create package 108, a pair of the opposite sides 3-1 and 3-3 of the square tray 1 are bent upwardly along the fold lines 20-2 and 20-4 which correspond to the long sides of the second interior rectangle of FIG. 1. Next, the four corners 5 of the tray 1 are bent upwardly along respective fold lines 16-1, 16-3, 16-5 and 16-7 which correspond to alternating sides of the interior octagon of FIG. 1. The upstanding corners 5 are then bent once again along the fold lines 16-1, 16-3, 16-5 and 16-7 so as to now be rotated downwardly and into interlocking receipt by respective openings formed through the tray 1 below push-down tabs 14.

By way of a final packaging example, the foldable tray 1 is bent to create a package 110 having a single area suitable to carry tall baked goods such as a pound cake, or the like. In this case, and referring concurrently to FIGS. 1 and 13, the carrying area of package 110 corresponds to the first interior rectangle of FIG. 1 established by the four sides (i.e., perimeter lines) 18-1 . . . 18-4. To create the package 110, a first pair of opposite corners 5 of the square tray 1 are bent upwardly along fold lines 16-3 and 16-7. The second pair of opposite corners 5 of tray 1 are bent upwardly along fold lines 18-2 and 18-4 which correspond to the long sides of the first interior rectangle of FIG. 1. The second pair of corners 5 are then bent and rotated downwardly at fold lines 16-1 and 16-5 for interlocking receipt by respective openings through the tray 1 formed below the push-down tabs 14.

Other packaging configurations (not shown) may be formed depending upon the particular baked goods to be carried therewithin and the set of perimeter fold lines along which the flat foldable square tray 1 is bent. Moreover, it is to be expressly understood that products and food items other than baked goods may be carried in any one or more of the packages created by bending the foldable tray 1 of this invention along the perimeter fold lines disclosed above and shown in FIG. 1.

The invention claimed is:

1. A foldable tray having four sides to define a rectangular outer perimeter and a plurality of fold lines lying inside said rectangular outer perimeter, said foldable tray adapted to be bent along selected ones of said plurality of fold lines to create a package in which products can be carried, said plurality of fold lines and the four sides of said rectangular outer perimeter aligned with one another to form the sides of a square, an octagon and at least one rectangle, each of said square, said octagon and said one rectangle lying inside the rectangular outer perimeter of said foldable tray, and each corner of said tray located between adjacent ones of the four sides of said rectangular outer perimeter having a slit formed therein, said foldable tray also having at least one divider removably attached thereto at the slits formed in a first pair of diagonally opposing corners when said first pair of corners are bent upwardly along respective ones of said plurality of fold lines, said divider establishing separate storage compartments of the package in which the products can be carried.

2. The foldable tray recited in claim 1, wherein each of the four sides of the outer perimeter of said tray is of identical length, whereby said outer perimeter is a square having a center and first and second pairs of opposite sides, the center of the square outer perimeter of said foldable tray and the centers of each of said square, said octagon, and said at least one rectangle which lie inside said outer perimeter being identical.

3. The foldable tray recited in claim 2, wherein the square which lies inside said outer perimeter has a longitudinal axis and a transverse axis that are arranged in perpendicular intersecting alignment with one another, said longitudinal and transverse axes lying on the diagonal axes of said square outer perimeter.

4. The foldable tray recited in claim 2, wherein alternating sides of the octagon which lies inside said square outer perimeter lie on adjacent ones of the four sides of said square outer perimeter.

5. The foldable tray recited in claim 2, wherein said at least one rectangle which lies inside said square outer perimeter has a major axis and a minor axis that is shorter than said major axis, said major and minor axes arranged in perpendicular intersecting alignment with one another and lying on the diagonal axes of said square outer perimeter.

6. The foldable tray recited in claim 2, wherein said at least one rectangle which lies inside said square outer perimeter has a first pair of opposite sides and a second pair of opposite sides which are shorter than said first pair of opposite sides, said first pair of opposite sides of said one rectangle running parallel to a first of said pairs of opposite sides of the square outer perimeter and said second pair of opposite sides of said one rectangle lying on the second pair of opposite sides of said square outer perimeter.

7. The foldable tray recited in claim 2, wherein the sides of said square outer perimeter and said plurality of fold lines are aligned relative to one another to also form the sides of a second rectangle lying inside said square outer perimeter, said at least one rectangle and said second rectangle having identical centers.

8. The foldable tray recited in claim 7, wherein each of said at least one rectangle and said second rectangle which lie inside said square outer perimeter has a first pair of opposite sides and a second pair of opposite sides which is shorter than said first pair of opposite sides, said first pairs of opposite sides of said one and second rectangles running parallel to a first of said pairs of opposite sides of said square outer perimeter, and said second pairs of opposite sides of said one and second rectangles lying on the second pair of opposite sides of said square outer perimeter, the second pair of opposite sides of said at least one rectangle being shorter than the second pair of opposite sides of said second rectangle.

9. The foldable tray recited in claim 7, wherein the sides of said square outer perimeter and said plurality of fold lines are aligned relative to one another to also form the sides of a third rectangle lying inside said square outer perimeter, said at least one rectangle, said second rectangle, and said third rectangle which lie inside said square outer perimeter all having identical centers.

10. The foldable tray recited in claim 1, also having a second divider removably attached thereto when all of the corners of the tray are bent upwardly along respective ones of said plurality of fold lines thereof, said second divider connected between the slits formed in a second pair of upwardly bent diagonally opposing corners of said tray.

11. The foldable tray recited in claim 10, wherein each of said first and second dividers has a coupling notch formed therein, the coupling notch of the first divider being slidably received through the coupling notch of the second divider, whereby said first and second dividers are coupled to one another.

12. The foldable tray recited in claim 11, wherein each of said first and second dividers has a fold line extending laterally thereacross, each divider adapted to be bent along the fold line thereof.

13. A foldable tray having an outside perimeter and a plurality of fold lines located within said outside perimeter, said outside perimeter and said plurality of fold lines being aligned relative to one another to form the sides of different geometric shapes, such that adjacent sides of each geometric shape intersect one another on the outside perimeter, said foldable tray adapted to be bent along selected ones of said plurality of fold lines to create packages in which products can be carried, each of at least two oppositely-aligned portions of the outside perimeter of said tray having a slit formed therein, said foldable tray also having at least one divider removably attached thereto at the slits formed in said two oppositely-aligned portions when said two portions are bent upwardly along respective ones of said plurality of fold lines, said divider establishing separate storage compartments in which the products can be carried.

14. The foldable tray recited in claim 13, wherein said outside perimeter is a square, said foldable tray having four sides of identical length, wherein each side is one portion of said outside perimeter.

15. The foldable tray recited in claim 13, wherein said different geometric shapes located within said outside perimeter and formed by the sides of said outside perimeter and said plurality of fold lines include at least a square, an octagon, and a rectangle.

* * * * *